US005195661A

United States Patent [19]

Light

[11] Patent Number: 5,195,661

[45] Date of Patent: Mar. 23, 1993

[54] COMPOSITE FLUID CARRIER

[75] Inventor: Bradley J. Light, Littleton, Colo.

[73] Assignee: Gas-O-Haul Incorporated, Aurora, Colo.

[21] Appl. No.: 576,688

[22] Filed: Aug. 31, 1990

Related U.S. Application Data

[63] Continuation-in-part of Ser. No. 264,780, Nov. 28, 1989, abandoned.

[51] Int. Cl.[5] ..... B65D 35/56

[52] U.S. Cl. ..... 222/105; 222/183; 222/527

[58] Field of Search ..... 222/105, 183, 215, 527-530, 222/535, 536, 537-539, 566-568

[56] References Cited

U.S. PATENT DOCUMENTS

| | | | |
|---|---|---|---|
| 3,087,655 | 4/1963 | Scholle | 222/183 |
| 3,160,326 | 12/1964 | Sturdevant et al. | 222/183 |
| 3,170,601 | 2/1965 | Daley | 222/183 |
| 3,171,573 | 3/1965 | Berney | 222/183 |
| 3,233,817 | 2/1966 | Casady | 222/105 X |
| 3,329,316 | 7/1967 | Lowe | 222/183 |
| 3,331,533 | 7/1967 | Krugger | 222/183 X |
| 3,349,960 | 10/1967 | Ketler | 222/183 X |
| 3,765,574 | 10/1973 | Urquiza | 222/183 |
| 3,937,363 | 2/1976 | Andersón | 222/105 |
| 4,154,367 | 5/1979 | Hanson et al. | 222/130 |
| 4,174,051 | 11/1979 | Edwards et al. | 222/183 X |
| 4,223,810 | 9/1980 | Sneider | 222/107 |
| 4,416,396 | 11/1983 | Ward | 222/530 X |
| 4,426,027 | 1/1984 | Maynard, Jr. | 222/530 X |
| 4,520,948 | 6/1985 | Hampel et al. | 222/105 X |
| 5,085,346 | 2/1992 | Wright | 222/183 X |

*Primary Examiner*—Kevin P. Shaver
*Attorney, Agent, or Firm*—Joseph C. Herring

[57] ABSTRACT

A fluid carrier is made up of at least a flexible inner container, a nozzle and an outer substantially rigid shell which may or may not be compressible or expandable and which can be enclosed with a protective enclosure prior to use. Carrier kits can also include flares, reflectors and other equipment.

14 Claims, 6 Drawing Sheets

COMPOSITE FLUID CARRIER

This application is a continuation in part of my U.S. patent application Ser. No. 07/264,780 filed Nov. 28, 1989, now abandoned.

SUMMARY OF THE AVAILABLE ART

Emergency gasoline carriers have evolved over the years from the rounded design of U.S. Pat. No. 2,516,728 issued to A. T. Smith, to the metal rectangular red and yellow cans gracing the trunks of autos and home garages over much of America.

Some variations on these basic gasoline carrier designs are: U.S. Pat. No. 3,170,601 issued to C. E. Daley. This patent teaches the use of a metal carrier enclosed in a fireproof insulator shell. The nozzle is hidden within and released from the shell by use of a ripcord.

U.S. Pat. No. 3,329,316 issued to J. C. Lowe and teaches a flattenable, disposable cardboard carrier. A pull tab is used to release the flattened cardboard spout from an enclosure on the side of the unit. A thin plastic liner is adhered to the inner surface of the unit at the spout and filler hole openings.

U.S. Pat. No. 4,236,655 issued to R. H. Humphries and teaches a blow molded unitary plastic container with a handle molded into the side and an accordion pleat in the base of the nozzle.

A quite different type emergency carrier is taught by U.S. Pat. No. 2,789,928 No. issued to J. H. Britton. The Britton carrier is made of plastic film in the form of a bag with a handle at the top. A portion of the bag separates to form a spout. A variety of other types of carriers for wine, milk, juices, etc. are also known. Unitary blow moulded containers are exemplified in U.S. Pat. No. 4,095,728 issued to W. K. Chylstun and U.S. Pat. No. 4,602,728 issued to S. M. Ha, both of which have collapsible, flexible nozzles with accordion pleats.

U.S. Pat. No. 4,726,491 issued to J. R. Moon has a container with an elongated spout capable of being pushed down into the container.

Plastic film bags are used to make a variety of "composite" containers. Basically, the composites are made up of a rigid plastic, cardboard, etc. outer shell substantially enclosing the plastic bag. Sometimes the rigid structure may be within a plastic ensealing enclosure. Typical patents are:

U.S. Pat. No. 3,160,326 issued to A. G. Sturdevant et al. teaches a noncollapsible composite package for liquids and powders, e.g. soap, which has a molded polyethylene enclosure within a cardboard carton.

U.S. Pat. No. 3,119,544 issued to P. E. Cope et al also teaches a composite which cannot be flattened prior to use. The outer and an intermediate carton is of paper board and encloses a substantially rigid inner plastic container.

U.S. Pat. No. 3,330,448 teaches a composite with a collapsible, flexible nozzle, and, finally, U.S. Pat. No. 4,557,395 teaches a container coupled with a funnel for receiving and transporting used engine oil.

While a number of the carriers described above have been commercially successful, improvements are needed. This is particularly true where the container is to be used as an emergency gasoline carrier. The trunks of automobiles often contain greasy spots and objects which can dent or penetrate such containers. They are also often hot enough to melt or deform many thermoplastics.

The carriers of this invention overcome many of the problems inherent in the design of emergency fluid carriers.

SUMMARY OF THE INVENTION

The composite fluid carriers are made up of at least a flexible inner container, a nozzle and an outer rigid shell which may or may not be compressible or expandable and which can be enclosed with a protective enclosure prior to use. The carriers can also include accessories such as folded funnels, filters, flares, reflectors, spare containers, and other equipment.

DETAILED DESCRIPTION OF THE DRAWINGS

Figure 1:
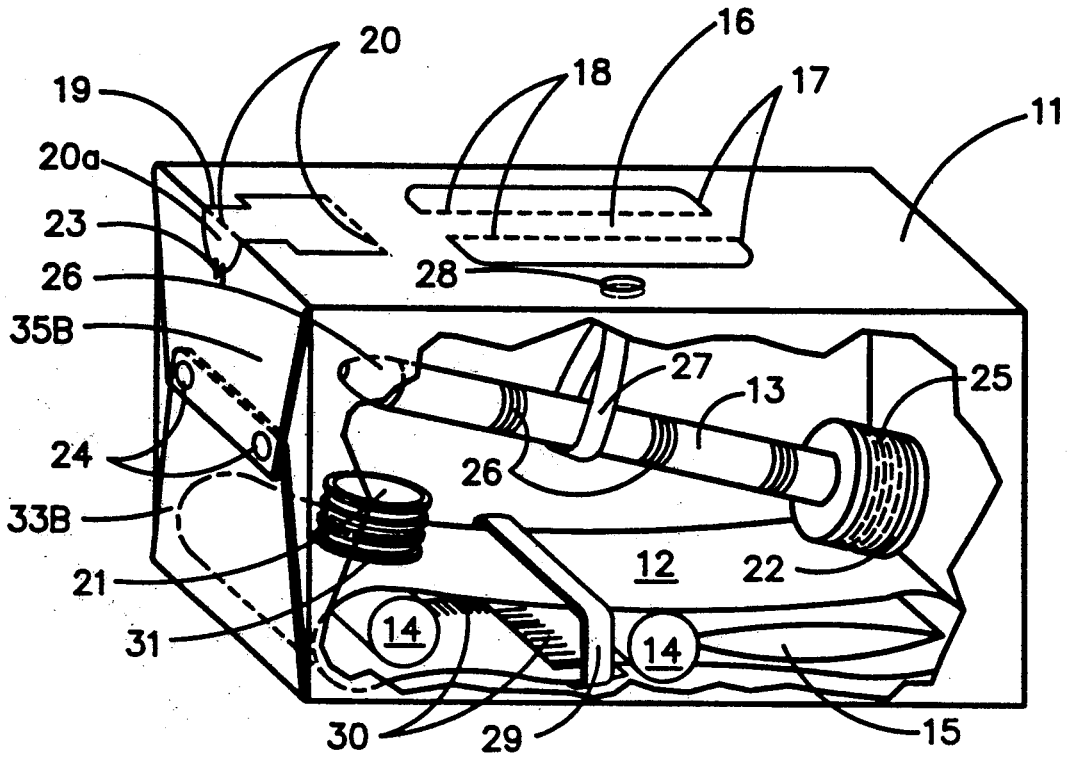
FIG. 1 depicts a partially cutaway unused fluid carrier with a view of its contents.

The emergency fluid carrier of FIG. 1 is partially cut away to permit a view of its contents. The carrier is made up of a paperboard shell 11, a container 12, and a nozzle 13. The accessories include ignitable flares 14 and a "Handi-Wipe" towelette 15 substantially enclosed by the empty, folded container 12.

The top of shell 11 has a handle 16 formed by cut lines 17 and bend (dashed) lines 18. The portions of the paperboard within the cut lines are folded under to reinforce the handle 16 (see FIG. 3). Cut line 19 and bend lines 20 form a seat and retainer 20A for the mouth 21 of container 12, to which the base 22 of nozzle 13 will be affixed. The retainer 20A is formed when the paperboard at point 23 is broken and the resulting tab is lifted (See FIG. 4). The shell 11 is sealed by glue spots 24 (only two shown) which hold the flaps 33B and 35. Nozzle 13 has a base 22 with retaining threads 25, accordion pleats 26 for flexibility and a sealed tip 26 which can be cut or "pinched" when the fluid is to be poured. The length of nozzle 13 fits it snugly between opposite corners of shell 11 but it is additionally secured by bands 27 which is attached to the shell wall by glue spots 28. Container 12 is held in place by a retaining, elastic band 29 which is secured to the bottom wall of shell 11. Additional bands 29 can also be used.

Container 12 is made up of sheets of nonelastic polymeric film which are thermally fused along lines 30. Container 12 is large enough to fill shell 11 when full and is folded for packaging as shown.

Figure 4:
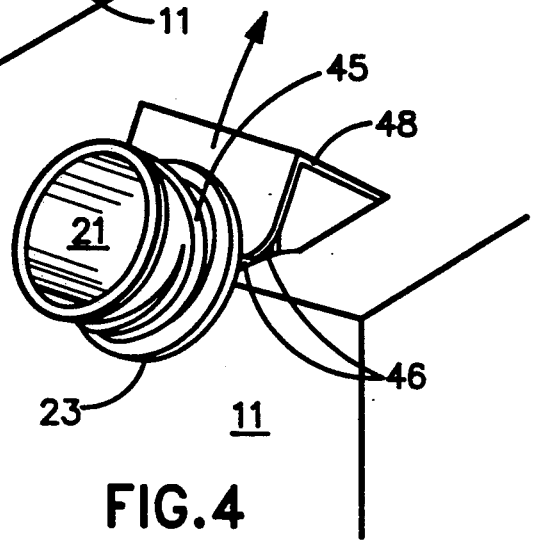
FIG. 4 details the physical relationship between the container mouth and the shell of FIG. 1.

Prior to use, the glue spots 24 are broken, the flaps 33B and 35B opened, the bands 27 and 29 broken, and the remaining contents removed. The flaps adjacent handle 16 are freed by being pushed down sufficiently hard to break the uncut material along the cut lines 17 and folded under. The retainer for the mouth of container 12 is freed by being pushed outward to break the material at point 23. The grooves 31 in the mouth 21 of container 11 is then locked in place as shown in FIG. 4.

Figure 2:
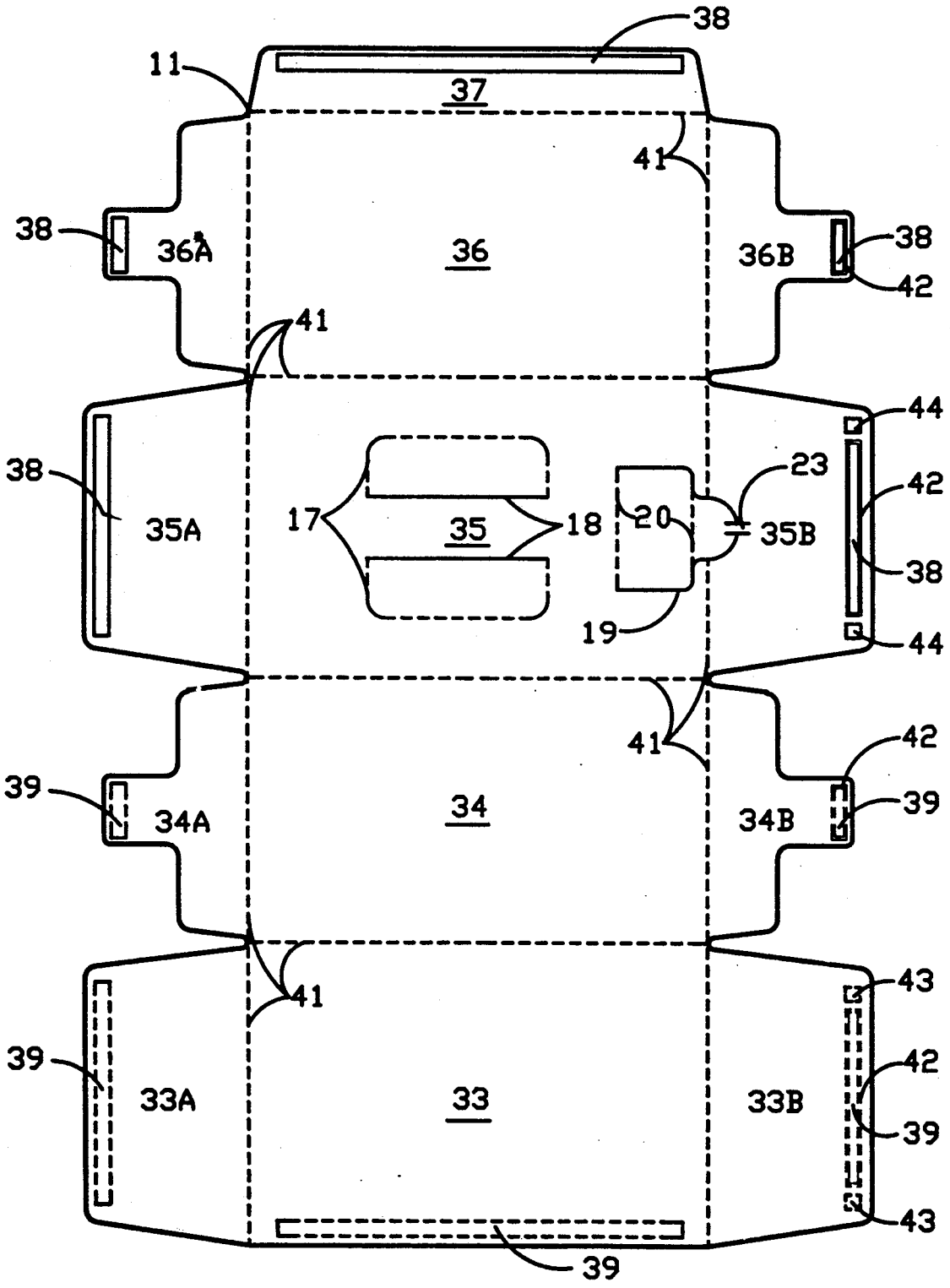
FIG. 2 is a plan view of the blank used for making the container of FIG. 1.

FIG. 2 is a plan view of the inner side of the die cut paperboard blank used in forming container 11 of FIG. 1. It is made up of four side panels 33, 34, 35, 36 and flap 37. Panel 35 is the top of the container 11 depicted in FIG. 1 and the bend and cut lines have the same identifying numbers used in the discussion of the container of FIG. 1. Each side panel has end flaps designated by the same numerals as the side panel and an "A" or a "B" to designate an end. Strips 38 of one half of a binary contact cement combination, that is, one which sticks only to the glue of the strips on the other half of the binary contact cement combination are affixed to the inner side of the blank and strips 39 of the other half of the glue combination are affixed to the outer side of the blank.

To assemble shell 11, panels 33, 34, 35, 36, and 37 are bent so as to form a box along bend lines 41. Strips 38 and 39 at the side of panels 33 and flap 37, respectively, are precisely aligned, then brought into contact to glue these panels into a square form. Strips 38 and 39 of end flaps 34A and 36A, respectively, are aligned precisely and pressed together to form a good bond. Strips 38 and 39 of end flaps 33A and 35A are then precisely aligned and pressed together to form a good bond. Strips 38 and 39 of end flaps 33B, 34B, 35B and 36B have a covering 42 to prevent premature adhesion to each other when these are bent inwardly to form the end of the box. End flaps 33B and 35B also have, respectively, pairs of a less strong binary adhesive spots 43 and 44. These pairs of spots are precisely aligned and pressed together to seal the now formed box but permit the end of shell 11 to be readily opened for assembly of the emergency fluid carrier.

Figure 3:
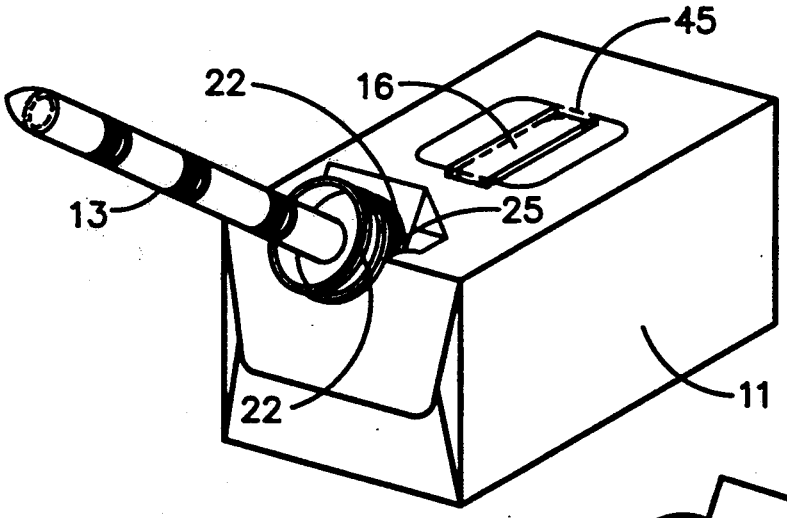
FIG. 3 depicts the assembled carrier of FIG. 1.

FIG. 3 shows the carrier of FIG. 1 fully assembled with a quick release nozzle 13 projecting from shell 11 and held in place through a groove 25 in the mouth 21 of container 12 (not shown). Handle 16 has been formed by bending the adjacent paperboard under as indicated by dashed lines 45.

FIG. 4 is a detailed view of a container mounth 21 secured within shell 11 by having a groove 46 in mouth 22 fitted over the curved seat 47 formed when the paperboard at point 23 (FIG. 1) is broken. The retainer 48 resulting at the break is thrust down into groove 46 of container mouth 21. The resilience of the paperboard causes the retainer 48 to press against the bottom of the groove 46 holding the mouth 21 in place. Mouth 21 has threads 49 instead of the ridges of the quick release of FIG. 1.

Figure 5:
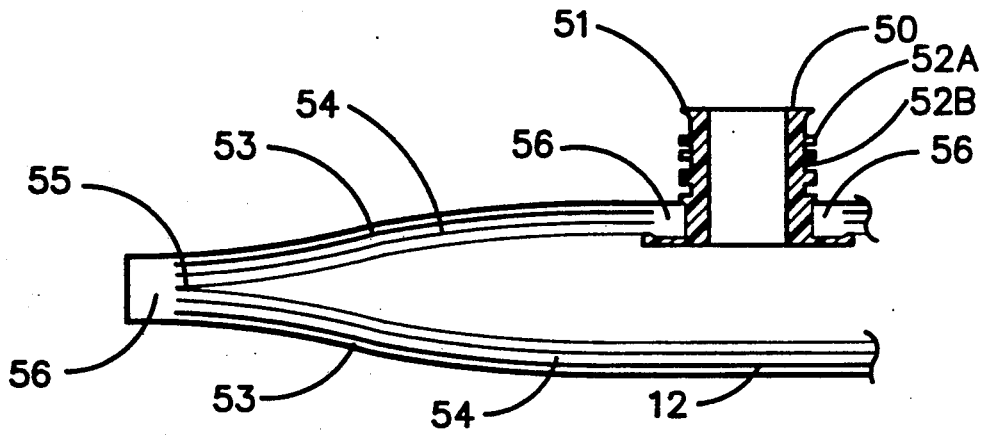
FIG. 5 is a section of the detail of a preferred container useful with the fluid carrier.

FIG. 5 depicts a view of a container 12 (FIG. 1) taken through the center of a quick release opening 50 showing the detail of a container 12. The outer edge of opening 50 has a lip 51 and lands 52A and grooves 52B which encircle the opening 50. Each side of the container is made up of a metalized layer 53 on a film 54 and a second layer of film 55. These layers are fused to each other at the edges and at opening 50 at fuse points 56.

Figure 6:
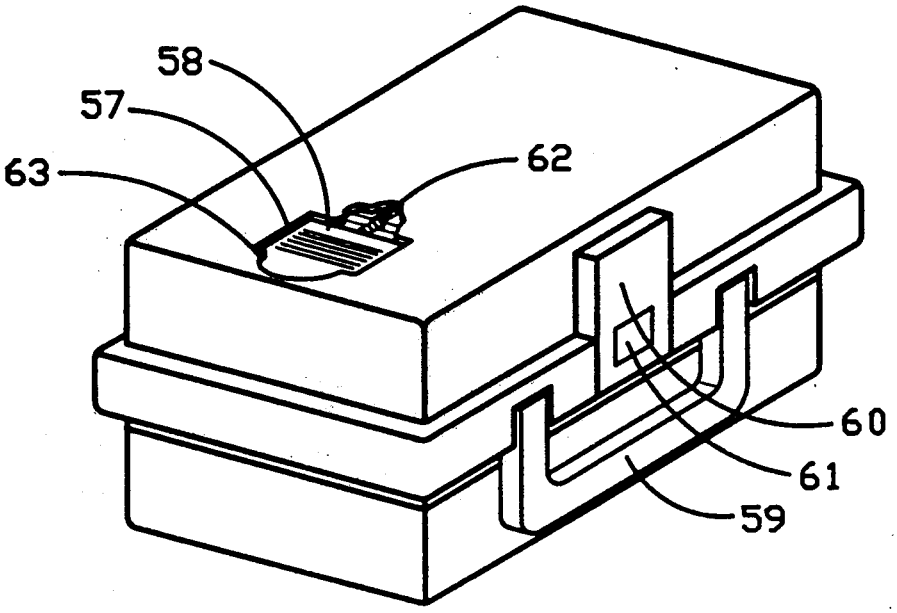
FIG. 6 depicts a blow molded shell for use with multiple containers.

FIG. 6 depicts a more permanent embodiment of the invention which utilizes a blow molded, hinged case with a retainer made up of an opening 57 closed by spring-loaded cover 58. The opening 57 has a groove 57A in its edges (see blow-up) into which a land 52A of FIG. 5 fits. Container(s) and, where desired, accessories, are stored within the case. The case has a handle 59 and a hinged locking mechanism 60 which locks by being fitted over a projection 61.

To assemble the carrier, the locking mechanism 60 is pulled outwardly, thus freeing it from projection 61, then one-half the case is pulled away from the other half. A container and any accessories are removed. Surplus containers and unused accessories are stored elsewhere for a time of future use. The cover 58 is pushed toward the center of the case 56 against the pressure of spring 62 shown in the cutaway. When the cover 58 is fully retracted, the mouth of the container (not shown) is pushed through the resulting opening. A land 52B in the side of the mouth (FIG. 5) of the container (not shown) is then slipped into a groove 57A in the edge 63 of opening 57 and cover 58 is released to slide against the land 52A, thereby locking the container opening in place during usage. The two halves of case 56 should not fit so tightly that air cannot flow into case 56 between the halves when fluid is being poured out of container.

Figure 7:
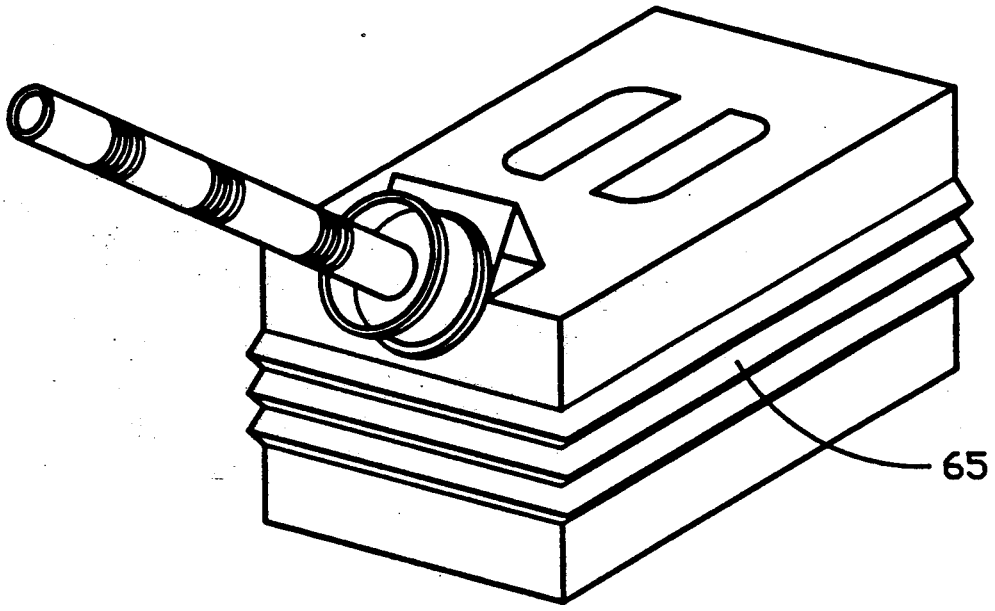
FIG. 7 depicts an assembled carrier unit with an accordion pleated shell.

The embodiment of FIG. 7 is similar to that of FIG. 1 except that accordion pleats 65 can be compressed when this embodiment is stored within a display film enclosure during storage and after removal of the enclosure expanded to a desired size when needed.

Figure 8:
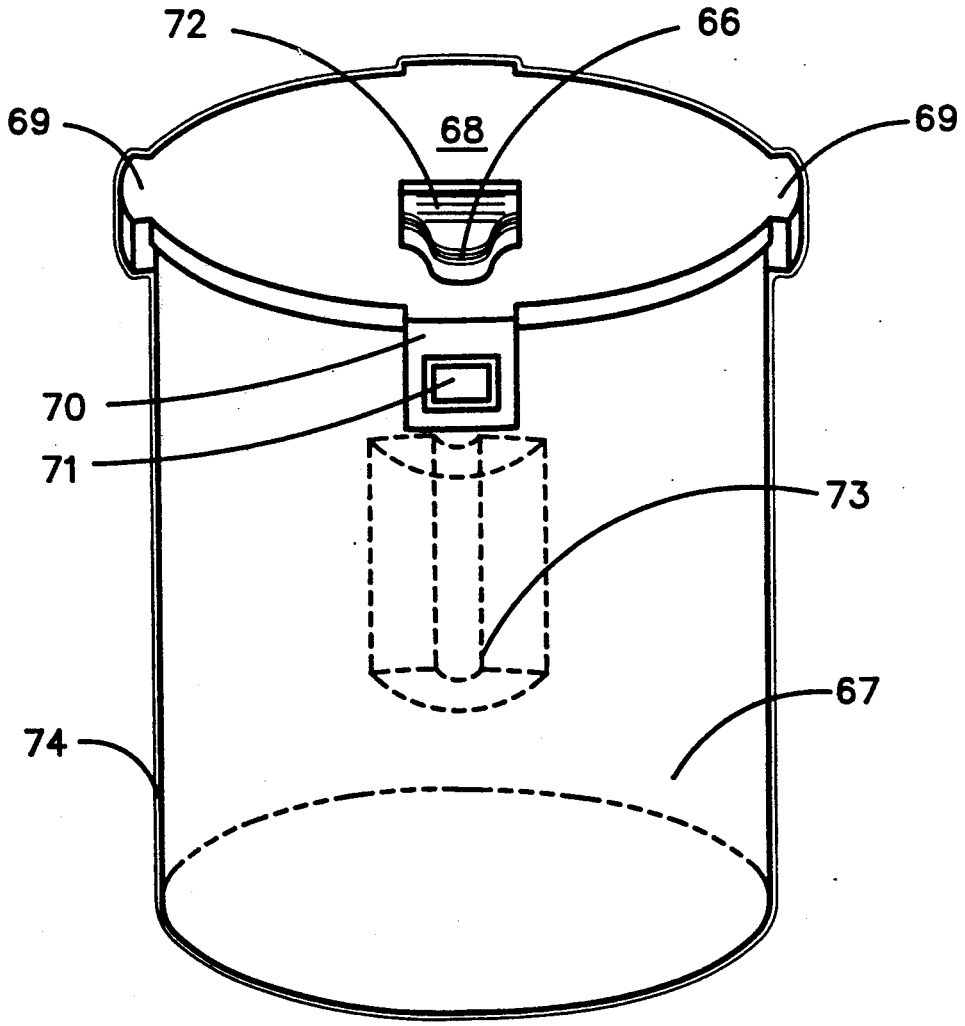
FIG. 8 depicts a round carrier shell within an enclosure.

FIG. 8 is a perspective view of a round shell enclosing other components of a carrier (now shown). The carrier is made up of a shell 67 with a lid 68 fused to one side of its upper edge. Lid 68 has positioning tabs 69 and a lock 70 which fits over post 71 on the opposite upper edge of container 67 from the fused hinge point. A slide lock 72 is used to hold the mouth of a container in place. The shell 67 has a molded handle 73 opposite lock 70. The entire carrier assembly is enclosed in a transparent plastic film 74 for shipment and storage.

Figure 9:
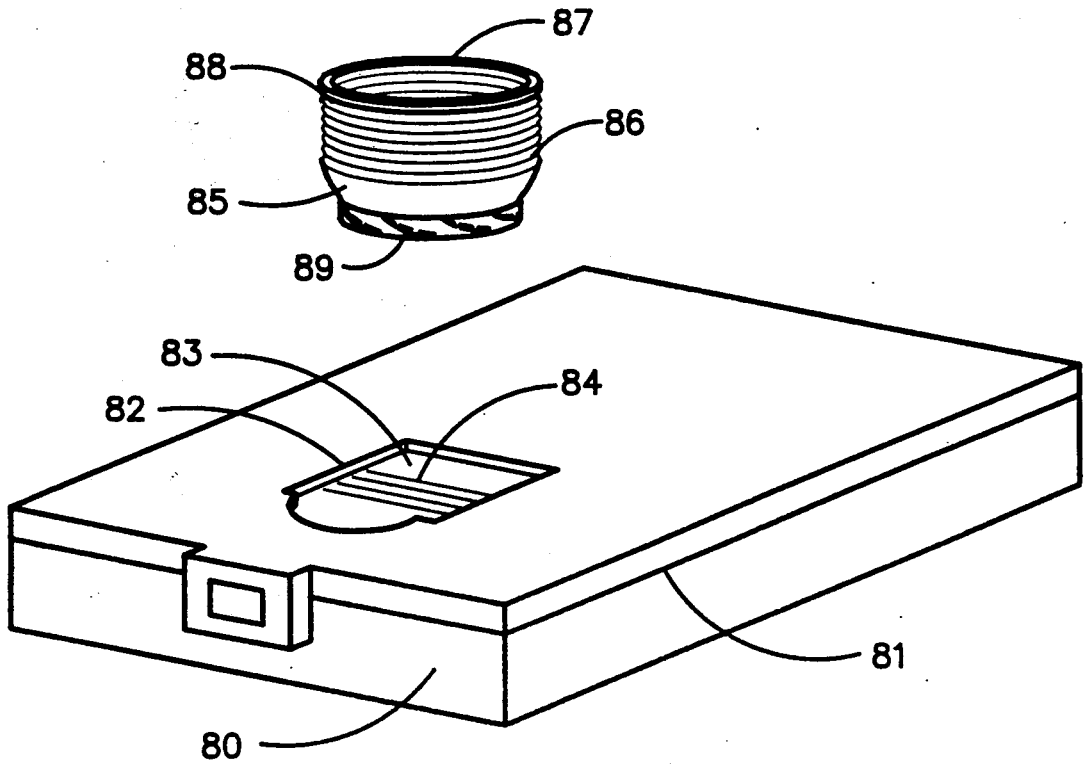
FIG. 9 depicts a carrier shell and nozzle suitable for use with automative oil changes.

FIG. 9 shows a thin shell 80, top 81 and retainer 82. Mechanism 82 has a closure 83 with indentations 84 to assist in retracting closure 83. An expandable nozzle 85 has self-standing accordion pleating 86 of the type taught in U.S. Pat. No. 4,492,313, an open top 87 with a groove 88. It also has quick release threads 89 which are screwed into a threaded mouth of a container. It should fit within container 80 when compressed.

Figure 10:
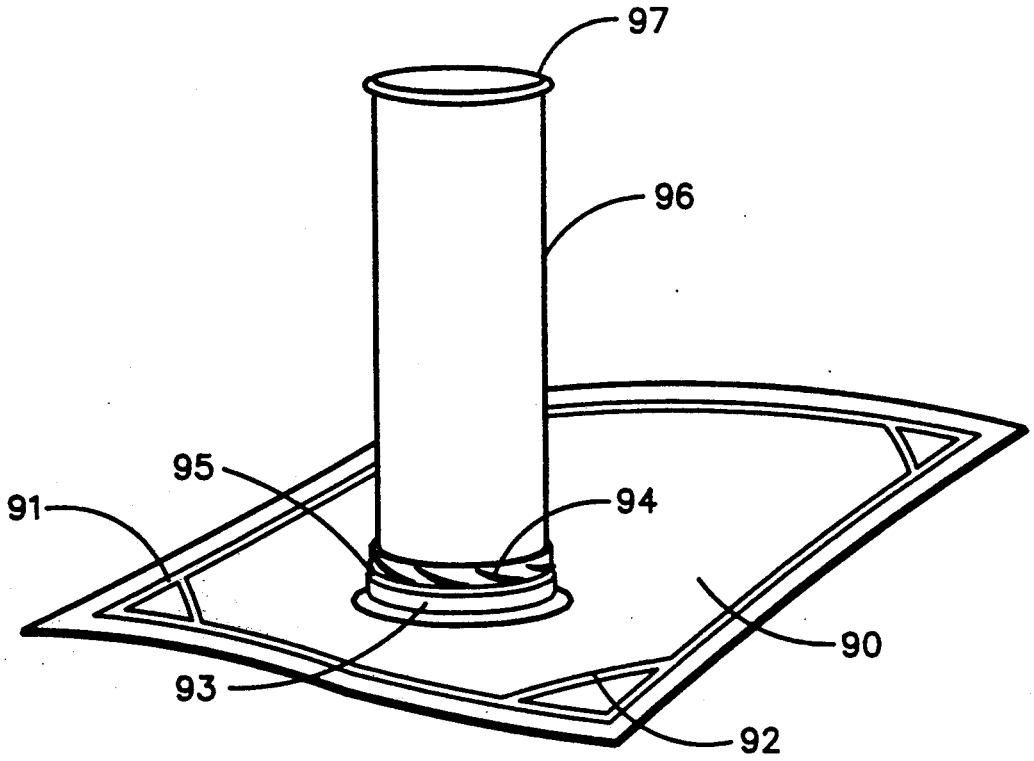
FIG. 10 depicts a flexible film container for use with the shell of FIG. 9.

FIG. 10 is a perspective view of parts of a container 90 utilized with the shell 80 of FIG. 9. It is made of polyester film thermally fused along seams 91 to form the container 90 and along seams 92 to brace the corners of container 90. A rigid mouth 93 has quick release threads 94 for connection to a nozzle, a groove 95 to slide into the connector mechanism of a container and a flexible film liner 96 designed to be pulled through and folded over the upper end of a nozzle to protect the inner surface of the nozzle. Liner 96 has an elastic ring 97 which can be fitted into the nonelastic groove adjacent the upper end of a nozzle, to hold the liner 96 in place.

Figure 11:
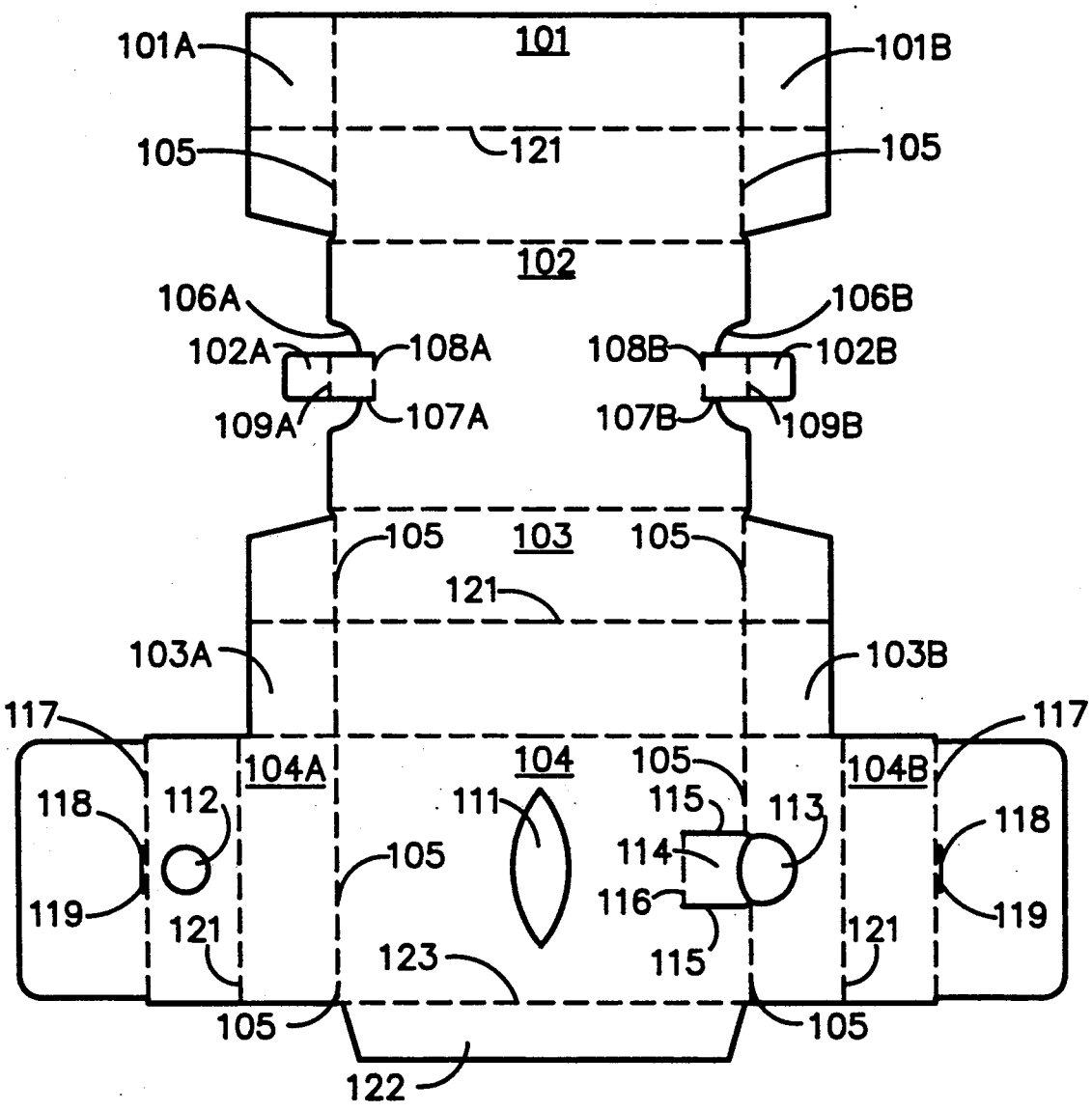
FIG. 11 is a plan view of a preferred embodiment blank.

FIG. 11 is a blank of a preferred embodiment requiring only one gluing operation or strip. The blank is made up of four side panels 101, 102, 103 and 104. Panels 101 and 103 have end flaps 101A and B and 103A and B, respectively, which can be bent inwardly along bend lines 105. Flaps 101A and B and 103A and B are tapered and cut away from panel 102. Panel 102 has two "finger" flaps 102A and B centered in concavities 106A and B. Finger flaps 102A and B are formed by cuts 107 A and B bendlines 108A and B. Additional bendlines 109A and B enable finger flaps 102A and B to be bent inwardly to form a locking mechanism.

Panel 104 has an eliptically shaped hole 111 which can be used as a carrying "handle". At one end there is a second circular hold 112 in flap 104A to be used while pouring fluids from the container. Panel 104 and flap 104B have a container mouth receptical 114 adjacent retainer 114 formed by cuts 115 and bendline 116. Flaps 104A and B also have bendlines 119 for finger flaps 102A and B when flaps 104C are bent inwardly along bendlines 117. The insertion of 102 A and B flaps into receptacles 119 forms a lock which holds the assembled carriet together without glue. A bendline 121 is used to flatten the container when flap 122 has been glued to the inside edge of panel 101. The flued but unassembled flattened container, with flaps 104A and B bent back upon themselves at bend line 122 can then be made a part of a larger package containing the nozzle container, etc. Preferably, a shrink wrap plastic film is used to form the larger container.

When a groove in the container mouth is inserted into the edges of hole 113, the retainer 114 is pushed into the edges of the groove to seat and hold the retainer mouth.

GENERAL DESCRIPTION OF THE INVENTION

The fluid carriers are made up of a shell, one or more containers and one or more nozzles. The carrier(s) can be sealed within a protective enclosure for shipping, storage, storage and display. The fluids to be carried include solid particulates, slurries and liquids.

The materials used to make each of these components should not dissolve, weaken, or swell appreciably in the fluid to be carried or in the presence of the materials to be encountered in the expected usage and storage environments. The environment of expected usage will determine whether strengthening, puncture or scuff resistance, insulation, vapor barriers, special form design, etc. are required to provide an effective carrier model.

The shell can be any shape but will normally be rectangular or round. The shape can be designed for a specified purpose, e.g., carrying gasoline or receiving and transporting used motor oil at the time of oil changes. It can also be designed for a specific storage place, e.g., in an out-of-the-way location in an auto trunk. The shell will normally be constructed of one or more of paper or fiberboard, corrugated paper and plastic sheathing. It can be pleated, telescoped, or otherwise designed for compression into a minimal volume where designed to enclose the nozzle container, etc. Alternatively, strips 38 and 39 can be used to attach flap 37 to panel 33 and the resulting box flattened. In such cases, the nozzle, etc. are stored outside the container within a shrink wrap plastic film or other container. It must also have a "connector mechanism" to connect it to the mouth of the container to hold it in place during filling and use. The retainer acts to maintain the "connection". In one preferred embodiment (e.g. FIG. 1) resistance to continued bending at the score or crease line acts as the locking mechanism. In another preferred embodiment, the geometry of the retainer is such that contact holds the container mouth in place (see FIG. 11).

The shell design can, depending on expected storage and use environments, have, for example, a water resistant outer surface, a hydrocarbon resistant inner surface or can be water and hydrocarbon resistant on both surfaces. Plastic oil change receptacles are preferably coated with a non-oil wetting surface to prevent discoloration by spillage, dust, etc. Metalized surfaces can be used to advantage with such containers. The shell can also contain or be coated with coatings containing fungicides, etc. to make it resistant to unwanted growths. The shell can, further, be insulated from changing temperatures, scuffing and puncturing, e.g., with metalized film, foam or film sheaths. Techniques and materials for providing these properties and protection are well known in the art.

Cases of the type depicted in FIG. 6 can be single or double walled and are generally made of a plastic, e.g., ABS, nylon or polystyrene, by thermal treatment, e.g., blow molding. Round designs can be made by thermo or vacuum forming. Such cases, without the opening for the container mouth, are widely produced for tool, gun, etc. cases. The manufacturing of paper containers, whether round, square, or other shape is equally well known as are the methods of die cutting and scoring for openings and bends.

The containers can be a single film or multiple films which are preferably substantially nonelastic and are quite flexible. Preferably, at least one layer of film will make up each side of the container and preferably at least one layer of film will have at least one metalized surface. The container will normally be made up of a film "bag" which has a rigid "mouth" for the introduction and removal of fluids.

In most embodiments, a flexible film will not extend into or through the mouth. In some models, however, a tube of plastic film can extend through both the mouth and nozzle, e.g., when the carrier is designed for use as a receptical and carrier for used motor oil during and after an automobile oil change. In such models, the tube, nozzle and/or the container mouth can include a closure mechanism, e.g., a cap, clip or other closure.

The films are preferably thermoplastic; are thermally fused at the edges, around the container mouth and, generally will be flat and square to rectangular in shape. The films will normally be made of polyalkenes, copolymers and polyhalo polymers. These films will have a thickness and tear strength sufficient for the designed purpose.

The corners of the containers will normally have additional reinforcing seals to round off or reduce the angles of seal and the usual stresses on corners.

The mouth of the container has a mechanism for attachment to the shell. Preferably, the mechanism will be at least one of a groove or land forming a groove. The mouth will be rigid adjacent the groove or lands and groove to ensure that the mouth of the container remains in place during usage. Preferably, the mouth is made up of a thermoformable, e.g. castable plastic, such as nylon or polyacetal.

The nozzle base and the container mouth can be connected in a fluid tight attachment by any conventional mechanism, i.e., by screw threading, a "quick release" mechanism, coupling of one elastic element with an inelastic element, a clamping mechanism separate from both the nozzle base and the container mouth, etc. The connection should prevent linear movement (into or out of the container) but can permit some twisting and/or lateral movement.

The nozzles used with this invention will be designed for the intended use, e.g., when designed for use as an emergency gasoline carrier, the nozzle diameter will be equal to or less than the nozzle diameter permitted for use with unleaded gasoline. It will also a length which will enable it to penetrate beyond the unleaded gasoline restricter in the fill pipe. On the other hand, where the carrier is to be used as a used motor oil receptical, the nozzle and container mouth can be three to four or more inches in diameter. The nozzle can be telescoping where required for packaging or other purposes. The nozzle can also contain an air return but this will not normally be necessary because of the lack of container rigidity, i.e., the container collapses as the fluid is decanted when the container is "vented".

The nozzles will normally be flexible. Flexibility will be provided by pleats or by the natural flexibility of the material from which the nozzle is made. Preferably, the nozzle is of a plastic, e.g. a polyvinyl chloride, but can be made of metal or a paper product.

The nozzle end closure (tip) is preferably a "pinch off" tip so that the container must be disposed of after usage. The nozzles with pinch off tips have scores around the nozzle adjacent the tip. When one desires to use the nozzles, a twist or pinch removes the tip. However, the standard screw-on caps can be used with more permanent carriers, e.g., with a metal nozzle.

The interlocking portions of the base of the nozzle and the mouth of the container with preferably be made of a rigid material, e.g., where threads are the attaching mechanism. A portion of one or the other of the mouth and nozzle can be nonrigid and resilient, e.g., where the attachment is by stretching an elastic rim or lip over the rim or lip of the other element. The elastic material will, of course, have sufficient resilience to ensure that the nozzle base and container mouth remain in fluid tight attachment during the filling and pouring of the fluid from the container.

The films used to enclose the shell are preferably heat shrink plastic but can be nonshrink plastic films, paper, etc.

Accessories useful with the carriers of this invention will be suitable for the end use. For example, flares or Cyalume lightsticks, tissues, and/or filters can be packaged with an emergency gasoline carrier.

Other modifications and embodiments will occur to those skilled in the art, e.g., a one-way valve on the mouth of the container or a sealable air inlet in the shell remote from the nozzle. Similarly, the container can have multiple nozzles and/or container mouths for specific applications. However, this type of modification is well within the skill of the journeyman in this art.

Now having described the invention, what I claim is:

1. An emergency liquid carrier consisting essentially of:

a) at least one empty, fluid tight, substantially nonelastic container with a single opening, the opening including a container mouth means for fluid tight connection to at least one nozzle;

b) said at least one nozzle having connection means for fluid tight external connection to the container mouth means; and c) a shell enclosing the at least one nozzle and the at least one container and including a first opening means for forming a retainer for the container mouth means and a second opening means for forming a second substantially larger opening than said first opening means, said shell including lock means for releasably locking together, portions of said shell defining said larger opening, said second opening means being for the removal of said at least one nozzle and to permit seating of the container mouth means within the first opening means from the inner side of the shell and the connection of the at least one nozzle to the container mouth means external to the shell.

2. The carrier of claim 1, wherein the shell is constructed of at least one of paperboard means, corrugated paper and plastic.

3. The carrier of claim 1 wherein at least one of the shell and the nozzle have self-standing accordion pleating.

4. The carrier of claim 1, wherein the shell is composed of a blow-molded plastic.

5. The carrier of claim 1, wherein the shell includes accordion pleating for varying the size of the shell.

6. The carrier of claim 1 wherein the nozzle includes accordion pleating for varying the longitudinal dimension the nozzle.

7. The carrier of claim 1, wherein said nozzle connection means comprises screw threads and the container mouth means includes corresponding screw threads to receive the screw threads of the nozzle connection means.

8. The carrier of claim 1, wherein said nozzle connection means comprises a quick release connector and the container mouth means includes a corresponding mating quick release connector to receive the quick release connector of the nozzle connection means.

9. The carrier of claim 1, wherein at least one of the shell and the container includes an insulating layer.

10. The carrier of claim 1, wherein the connection means of the nozzle includes a base and where at least one of the container mouth means and the base is at least in part formed of an elastically deformable material.

11. The carrier of claim 1, wherein the container comprises flexible plastic film.

12. The carrier of claim 11, wherein said flexible plastic film includes a metalized layer.

13. The carrier of claim 1, wherein said shell is enclosed within a protective film.

14. The carrier of claim 13, wherein the nozzle includes accordion pleats.

* * * * *